US005477253A

United States Patent [19]

Hotomi et al.

[11] Patent Number: 5,477,253

[45] Date of Patent: Dec. 19, 1995

[54] INK JET RECORDING APPARATUS

[75] Inventors: Hideo Hotomi, Ibaragi; Osamu Ebisu, Toyonaka, both of Japan

[73] Assignee: Minolta Camera Kabushiki Kaisha, Osaka, Japan

[21] Appl. No.: 975,435

[22] Filed: Nov. 12, 1992

[30] Foreign Application Priority Data

Nov. 13, 1991 [JP] Japan ..... 3-296798

[51] Int. Cl.[6] ..... B41J 2/045

[52] U.S. Cl. ..... 347/71

[58] Field of Search ..... 346/140 R; 347/68, 347/69, 71, 9; B41J 2/045, 2/055

[56] References Cited

U.S. PATENT DOCUMENTS

| | | | |
|---|---|---|---|
| 3,179,042 | 4/1965 | Naiman | 346/140 R |
| 4,439,780 | 3/1984 | DeYoung et al. | 347/68 |
| 4,459,601 | 7/1984 | Howkins | 347/68 |
| 4,523,121 | 6/1985 | Takahashi et al. | 310/334 |
| 4,788,557 | 11/1988 | Howkins | 346/140 R X |
| 4,819,014 | 4/1989 | Yasuhara et al. | 346/140 R |
| 4,887,100 | 12/1989 | Michaelis et al. | 346/140 R |
| 5,016,028 | 5/1991 | Temple | 346/140 R |
| 5,270,740 | 12/1993 | Naruse et al. | 346/140 R |
| 5,351,183 | 9/1994 | Takashashi et al. | 347/69 |

FOREIGN PATENT DOCUMENTS

| | | | |
|---|---|---|---|
| 59-164151 | 9/1984 | Japan | 347/9 |
| 4-148934 | 5/1992 | Japan . | |
| 4-247944 | 9/1992 | Japan . | |

*Primary Examiner*—Benjamin R. Fuller
*Assistant Examiner*—Alrick Bobb
*Attorney, Agent, or Firm*—Willian Brinks Hofer Gilson & Lione

[57] ABSTRACT

Disclosed is an ink jet recording apparatus comprising a piezo-electric body having a plurality of protruding portions; pairs of electrodes each provided on both side surfaces of each protruding portion; a supporting member having a plurality of hollow portions, which are engaged with the plurality of protruding portions in a manner that the space between the top surface of each protruding portion and the inner surface of the bottom of each hollow portion is made an ink room; a plurality of openings each leading to a corresponding ink room; ink supplying devices for supplying ink to the ink rooms; and voltage applying devices for applying voltage between each pair of the electrodes to generate an electric field, which serves to vibrate each protruding portion, thereby jetting ink in the ink rooms in the form of a droplet through the openings.

15 Claims, 11 Drawing Sheets

INK JET RECORDING APPARATUS

BACKGROUND OF THE INVENTION (1) Field of the Invention

This invention relates to an ink jet recording apparatus which utilizes a piezo-electric body.

(2) Description of the Related Art

One conventional ink jet recording apparatus is disclosed in U.S. Pat. No. 4,819,014, in which, as shown in FIG. 1, a piezo-electric plate 51 has a plurality of elongated ink cavities each comprising two deep grooves 52 and a shallow groove 53 therebetween, a cover plate 54 being fixedly placed on the plate 51. An electrode 55 is provided on the lower surface of the plate 51. And another electrode 56 is provided on the inner surface of the bottom of the ink cavity in such a manner that it is confronted with the electrode 55 through the plate 51. A certain voltage is applied between the electrodes 55 and 56, so that ink in each ink cavity is jetted in the form of a droplet from a nozzle hole 57 as a result of its volume being varied in thickness vibration mode.

However, according to the above-mentioned construction, the distance h between the electrodes 55 and 56 must be as long as 500 μm or so to sufficiently vary the volume of the ink cavity. Such a long distance demands considerably high voltage to be applied between the electrodes 55 and 56, and accordingly an expensive driver device. In addition, the piezo-electric plate 51 requires a complicated grooving thereon, which also leads to high production cost.

SUMMARY OF THE INVENTION

An object of this invention is to provide an ink jet recording apparatus managing with low voltage applied in order to vary the volume of a piezo-electric body.

The above object can be achieved by providing the piezo-electric body with a protruding portion protruding into an ink room and with a pair of electrodes on the side surfaces thereof to generate an electric field.

According to such a construction, the distance between the electrodes can be shortened, and as a consequence, the electric field having enough strength to vary the volume of the piezo-electric body can be generated with low voltage. This feature makes it possible for such an apparatus to employ inexpensive devices including a driver to apply voltage between the electrodes, thereby to easily reduce the production cost of such an ink jet recording apparatus.

The other object of this invention is to provide an ink jet recording apparatus whose piezo-electric body is simple in shape and easy to manufacture.

This object can be achieved by engaging a piezo-electric body having a protruding portion with a supporting member having a hollow portion in such a manner that the space between the top surface of the protruding portion and the inner surface of the bottom of the hollow portion is made an ink room.

According to this construction, the piezo-electric body requires just a simple forming process of the protruding portion, which also leads to reduction of the production cost.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

Preferred embodiments of this invention will be described with reference to the accompanying drawings.

Figure 1:
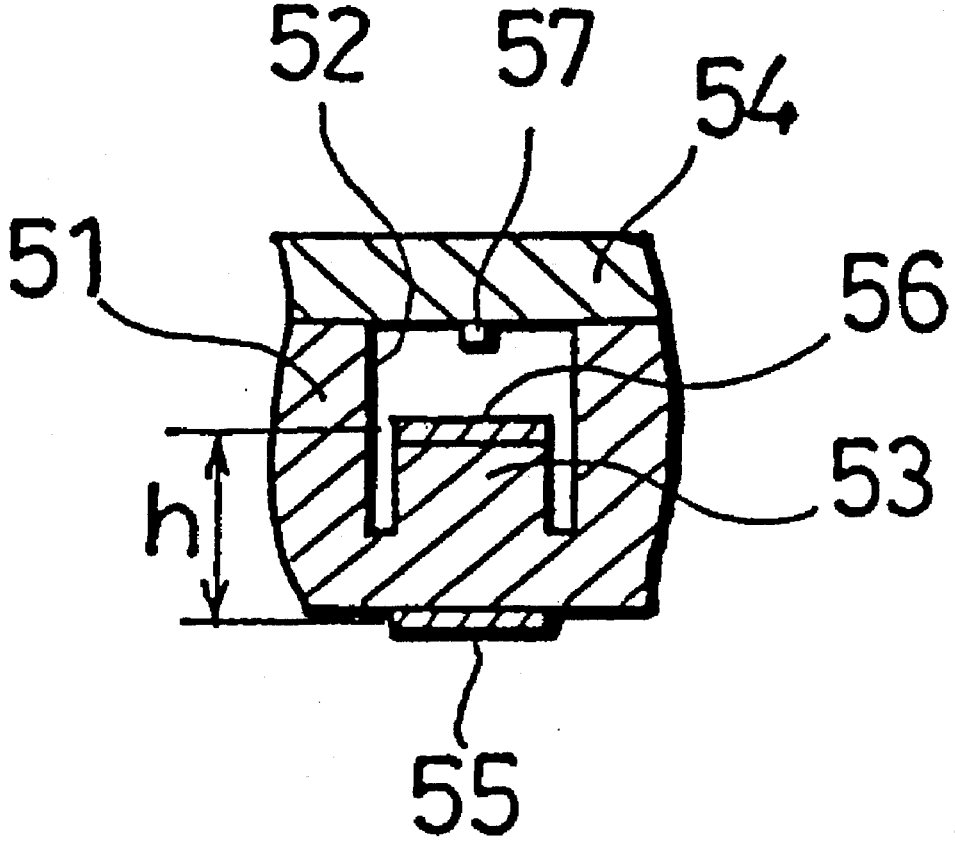
FIG. 1 (Prior Art)
FIG. 1 is a sectional view of the multi-nozzle head in a conventional ink jet recording apparatus.
Figure 2:
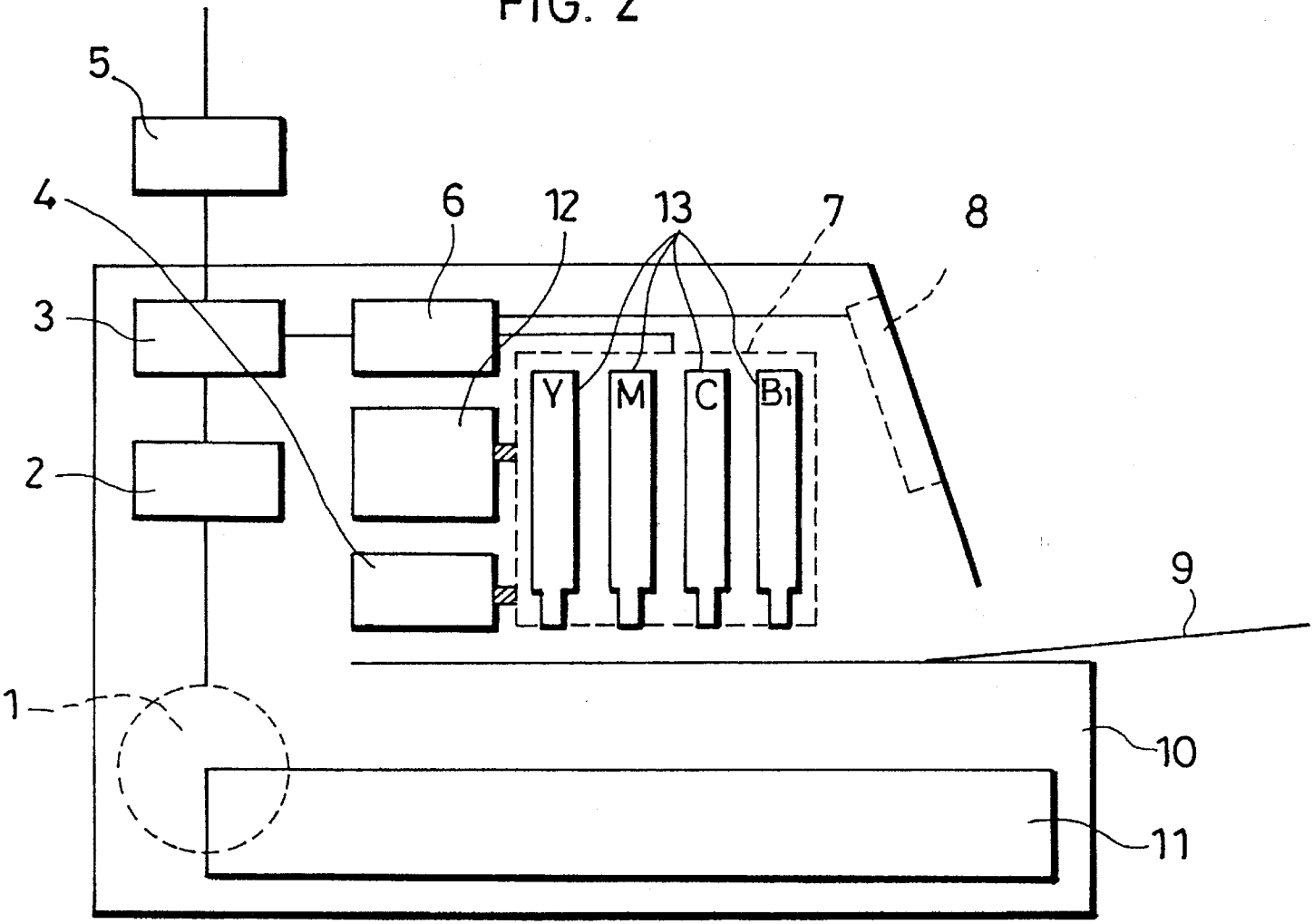
FIG. 2 is an overall constructional view of the ink jet recording apparatus of an embodiment of this invention.

As shown in FIG. 2, the ink jet recording apparatus of this embodiment comprises a paper feed driving system 1, a main engine controller 2, a controller 3, a cleaning/recovering mechanism 4, an interface 5, a driver unit 6, a line head unit 7, an operating unit 8, a paper tray 9, a main body 10, a recording paper cassette 11, and an ink supply cartridge 12, the line head unit 7 having a multi-nozzle head 13 corresponding to four colors: yellow, magenta, cyanogen, and black.

Figure 3:
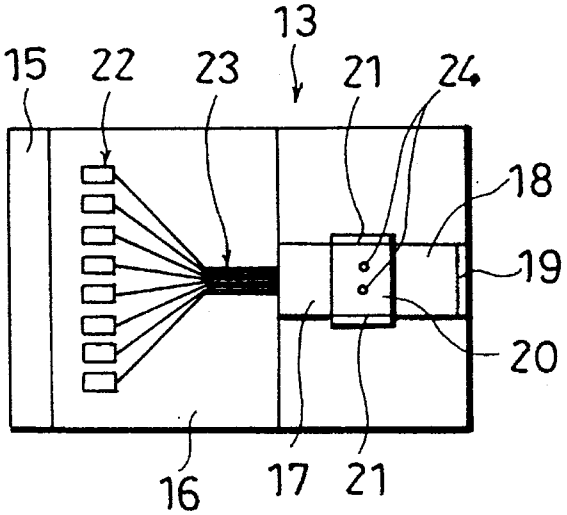
FIG. 3 is a plan view of the multi-nozzle head of the ink jet recording apparatus of the same.
Figure 4:
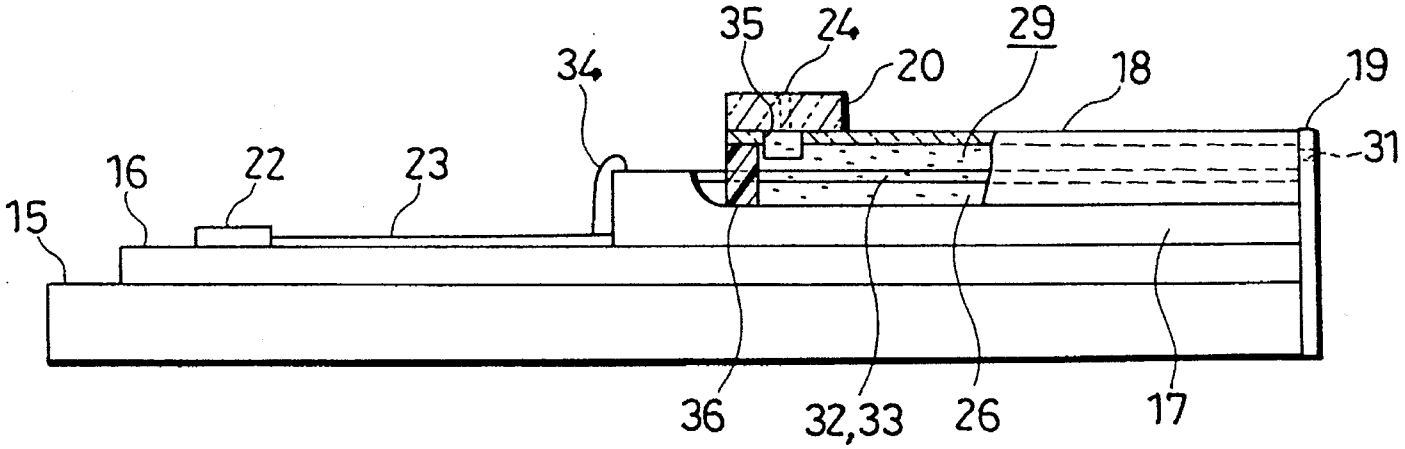
FIG. 4 is a sectional view of the multi-nozzle head of the same, taken in the direction of its depth.

The construction of the multi-nozzle head 13 will be described as follows with reference to FIGS. 3 through 7. The multi-nozzle head 13, as shown in FIGS. 3 and 4, includes a base plate 15 having a terminal board 16 and a piezo-electric body 17 made from piezo-electric ceramics or the like thereon. A supporting member 18 is fixedly placed on the piezo-electric body 17 with a glue 28 of epoxy resin. The base plate 15, the terminal board 16, and the supporting member 18 can be made from glass or the like.

Figure 5:
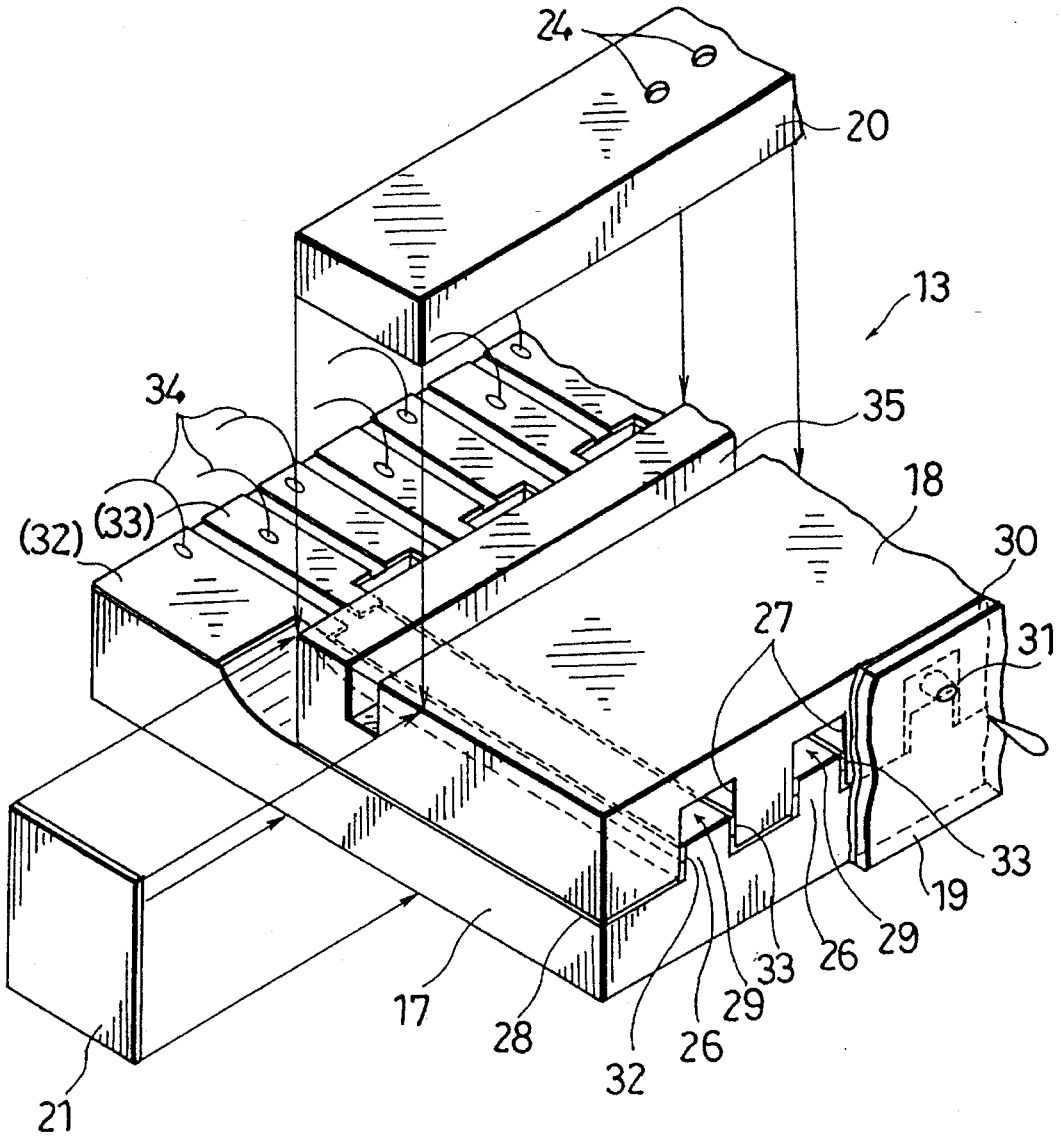
FIG. 5 is a perspective view of the main part of the multi-nozzle head of the same.
Figure 6:
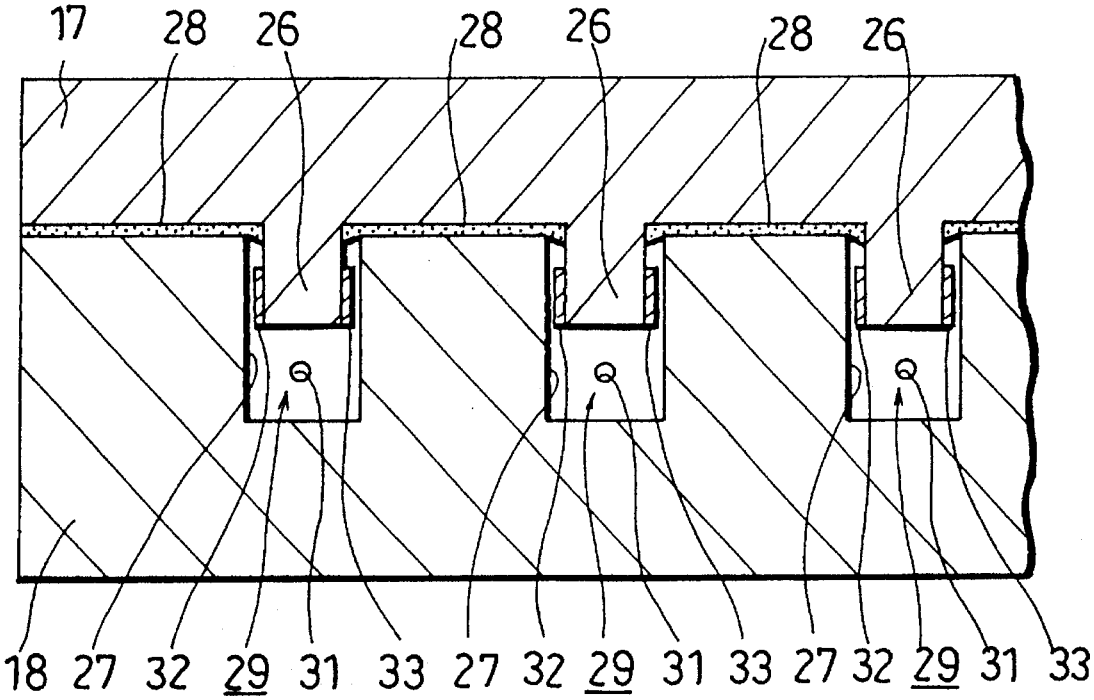
FIG. 6 is a sectional view of the main part of the multi-nozzle head of the same, taken in the direction of its width.

As shown in FIGS. 5 and 6, the piezo-electric body 17 has a number of elongated protruding portions 26 formed except the back area of the piezo-electric body 17 at a regular pitch. The back area is equal in height to the protruding portion 26.

The predetermined pitch is made 62.5 to 250 μm when the multi-nozzle head 13 is designed for images of 100 to 400 dpi. The width of each protruding portion 26 is about 30 to 130 μm, and the depth of the supporting member 18 is about 5 to 20 mm.

Each protruding portion 26 is provided with an electrode 32 on one side surface thereof and an electrode 33 on the other side surface. Both the electrodes 32 and 33 extend as far as the top surface of the protruding portion 26. The piezo-electric body 17 is polarized in the same direction as an electric field is formed between the electrode 32 and 33. This direction crosses the direction of ink jetting, which will be described later. The electrodes 32 and 33 are preferably formed in a range from the top surface of the protruding portion 26 to more than 20% of its height. Otherwise, the degree of the volume variation is inefficient to generate enough pressure for ink jetting.

The supporting member 18 has a number of grooves 27 which are hollowed out of the member 18. The grooves 27 engage with each protruding portion 26 in such a manner that the space between the top surface of the protruding portion 26 and the inner surface of the bottom of the groove 27 is made an ink room 29.

The supporting member 18 further has an ink supply slit 35 leading to all the ink rooms 29, the upper and both side surfaces of the slit 35 is respectively covered with an ink lid 20 and a covering plate 21 made of glass or the like. The ink lid 20 has two holes 24 to supply oily ink containing pigments dispersed therein. The grooves 27 in the region of the back area of the supporting member 18 are filled with resin 36 as shown in FIG. 4.

Figure 7:
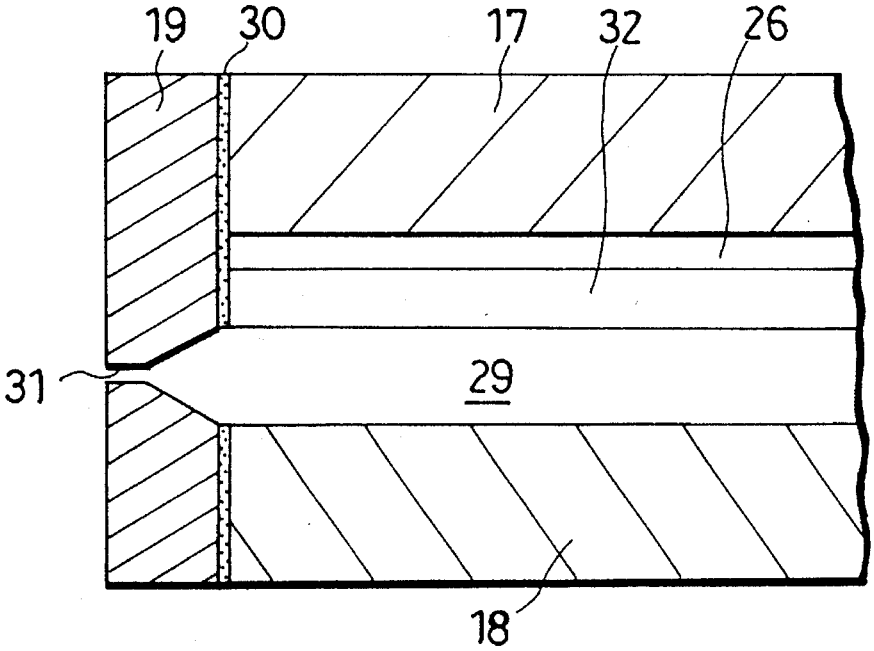
FIG. 7 is a sectional view of the main part of the multi-nozzle head of the same, taken in the direction of its depth.
Figure 8A:
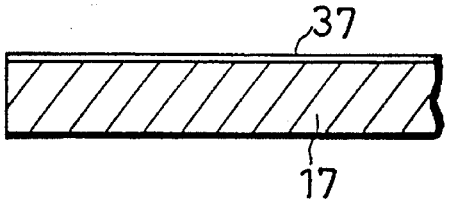
FIG. 8(A)–8(F) illustrate the manufacturing process of the multi-nozzle head of the same.
Figure 8B:
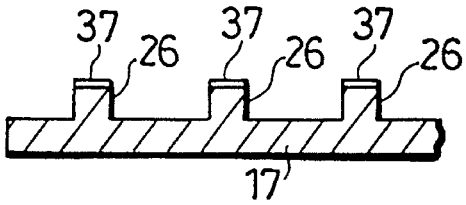
Figure 8C:
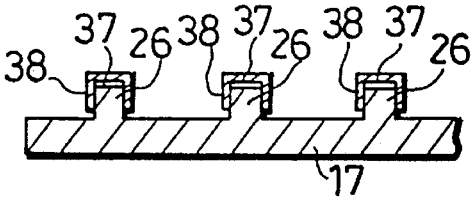
Figure 8D:
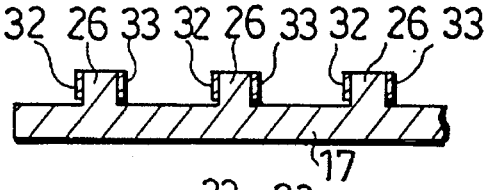
Figure 8E:
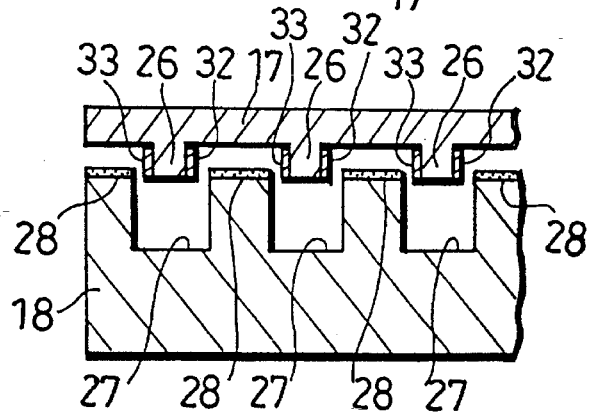
Figure 8F:
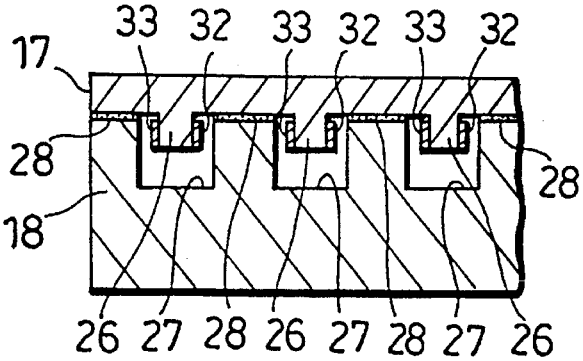

As shown in FIG. 7, a nozzle plate 19, which has a number of forwardly tapered nozzle holes 31 leading to each ink room 29, is fixed on the front surface of both the piezo-electric body 17 and the supporting member 18 with a glue 30 of epoxy resin. Polyimide film having a thickness of about 25 to 200 μm (Toray, KAPTON) can be used as the nozzle plate 19, and the diameter of the nozzle holes 31 is about 20 to 100 μm.

On the terminal board 16, a number of terminals 22 and a number of conductors 23 connected with each terminal 22 are fixed by metal vapor deposition as shown in FIG. 3. Each conductor 23 is connected with both electrodes 32 and 33 via a conductive line 34 as shown in FIG. 4, each terminal 22 being connected with the driver unit 6 shown in FIG. 2.

When the depth of the supporting member 18 is around 5 to 20 mm, an about 10 to 200 V voltage will be quite enough to make ink jet, or alternating voltage can be added thereto. In the latter case the alternating voltage is preferably used in the frequency of 1 kHz to 10 MHz.

Unillustrated recording paper is preferable to be put with a distance of about 0.2 to 5 mm from the nozzle hole 31. With a distance shorter than 0.2 mm, the multi-nozzle head 13 would be hard to hold away from the recording paper, while with a distance longer than 5 mm, ink may fall short of the recording paper. This is because the particles of charged ink are repulsive to one another by electrostatic repulsive force.

The manufacturing process of the main part of the multi-nozzle head 13 will be described as follows with reference to FIG. 8(A)–8(F).

First, the piezo-electric body 17 which has been polarized and then released from electrodes is coated with a resist 37 on its upper surface as shown at (A).

Then, a number of grooves are formed with a dicing saw on the upper surface of the piezo-electric body 17 with the resist 37 thereon, so that the protruding portions 26 are formed as shown at (B).

The protruding portions 26 with the resist 37 on the top surface are then coated with metal film 38 by slanted vapor deposition method as shown at (C).

The metal film 38 on the top surface of the protruding portions 26 is get rid of as the result of the resist 37 being melted by infiltrating etching liquid in the longitudinal direction of the protruding portions 26 while the metal film 38 on the side surfaces remains, so that electrodes 32 and 33 can be formed thereon, as shown at (D).

The supporting member 18 with the glue 28 thereon is then made face the piezo-electric body 17 so that the protruding portions 26 of the member 18 can be engaged with the hollowed grooves 27 of the body 17 leaving some space therebetween as shown at (E).

The supporting member 18 and the piezo-electric body 17 thus engaged with each other are baked to harden the glue 28 as shown at (F).

Finally, polyimide film as the nozzle plate 19 is applied on the front surface of both the piezo-electric body 17 and the supporting member 18, and then the nozzle holes 31 are formed by excimer laser.

The following is an operational description of the apparatus.

Figure 9:
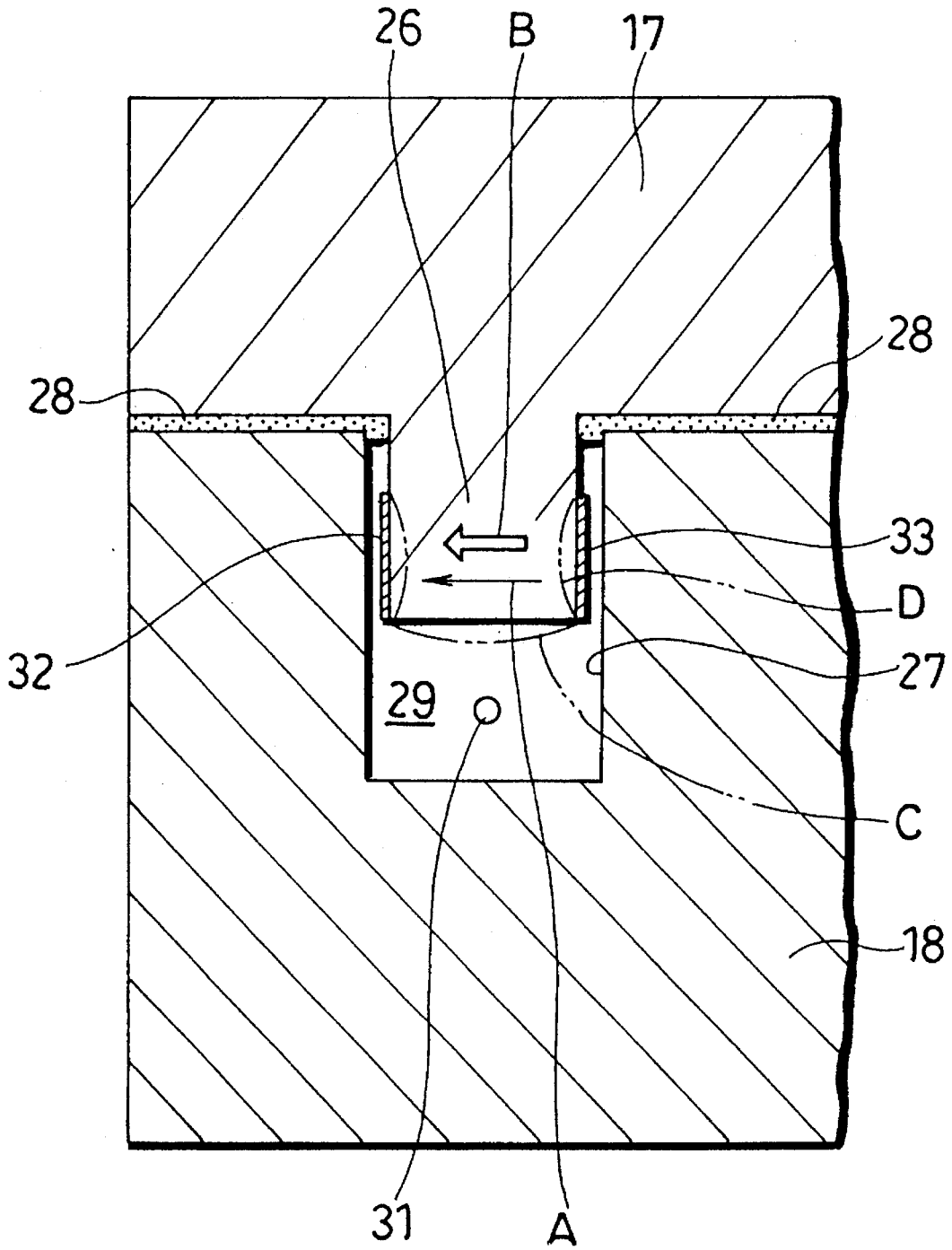
FIG. 9 is an operational view of the multi-nozzle head of the same.

When pulse voltage in accordance with image signals is applied between the electrodes 32 and 33 by the driver unit 6, the electric field is formed between the electrodes 32 and 33 as pointed by an arrow A in FIG. 9. At this moment, the bottom surface of the protruding portions 26 is curved in length vibration mode as indicated by the two-dot chain line C because the piezo-electric body 17 is polarized in the direction pointed by an arrow B. Accordingly, the volume of each ink room 29 is diminished. As a result, ink in the ink room 29 is given pressure, jets through the nozzle hole 31, and adheres to the recording paper not shown. Although the side surfaces of the protruding portion 26 curve outwards as indicated by the two-dot chain line D at this moment, the gap between the side surfaces of both portions 26 and 27 is extremely narrow, so that ink in the ink room 29 hardly runs into this gap.

When the voltage between the electrodes 32 and 33 is released, the protruding portion 26 returns to its original shape indicated by a full line and as a consequence, the volume of the ink room 29 also returns to its original shape. Accordingly, ink is supplied to the ink room 29 through the ink supply slit 35.

The operation described hereinbefore is carried out for one ink room 29 after another or for all of them at once depending on image signals, and as a result, images for one line is drawn. This is continued synchronously with the movement of the recording paper, images according to image signals being drawn on the paper.

Thus the electrodes 32 and 33 are provided on both side surfaces of each protruding portion 26 and the volume of the portion 26 is varied in length vibration mode, so that the distance between these electrodes can be shortened and as a result, applying voltage thereto can be reduced. In addition, the piezo-electric body 17 is polarized in the same direction as the electric field is formed between the electrode 32 and 33, while the ink is jetted across this direction, which leads to efficient ink jetting. Thus the cost of the driver unit 6 is substantially reduced. In addition, the piezo-electric body 17 does not demand a complicated grooving, which also leads to reduction of the production cost in addition to enhancing processing accuracy.

The following are descriptions of the other embodiments of this invention referring to figures.

Figure 10:
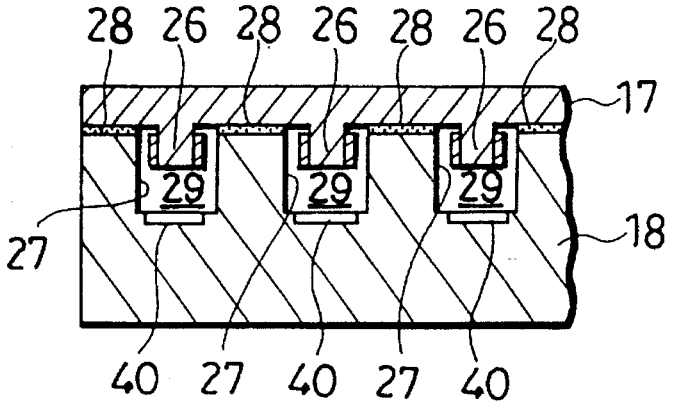
FIG. 10 is a sectional view of the multi-nozzle head of another embodiment of this invention.

As shown in FIG. 10, a thermal head heater 40 or the like may be provided on the outer surface of the bottom of the grooves 27 in order that the affection of outside temperature is minimized, and accordingly ink with high viscosity can be used.

Figure 11:
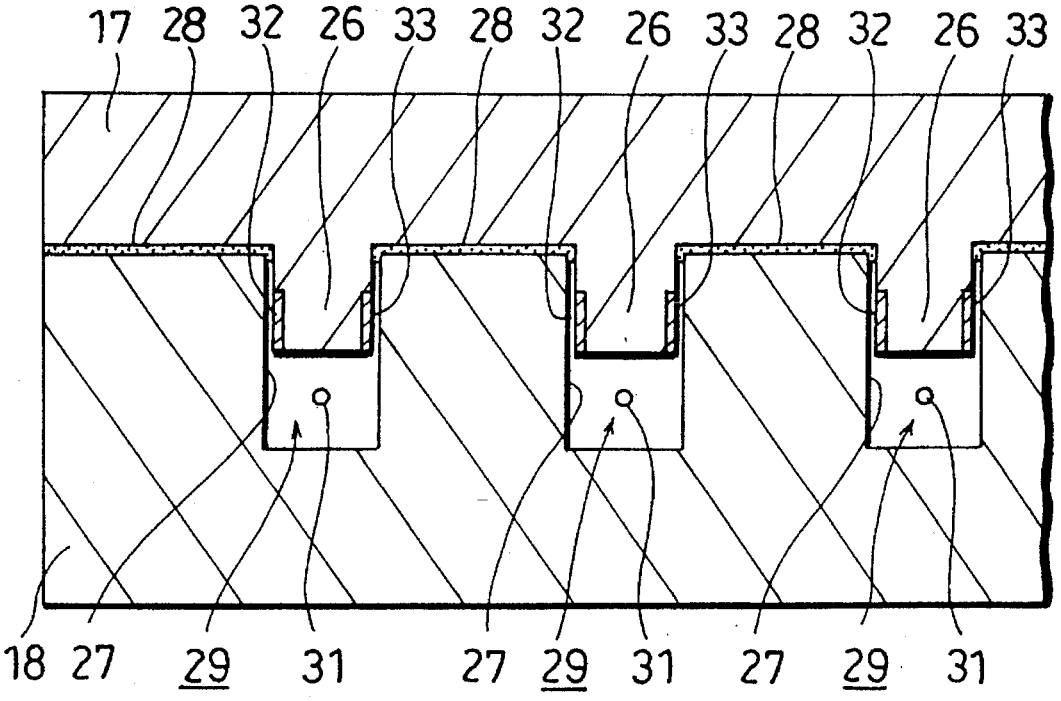
FIG. 11 is a sectional view of the multi-nozzle head of further another embodiment of this invention.

As shown in FIG. 11, a cutting can be formed on each side surface of the protruding portion 26 to bury the electrodes 32 and 33 therein so that both side surfaces have no bulges.

Figure 12:
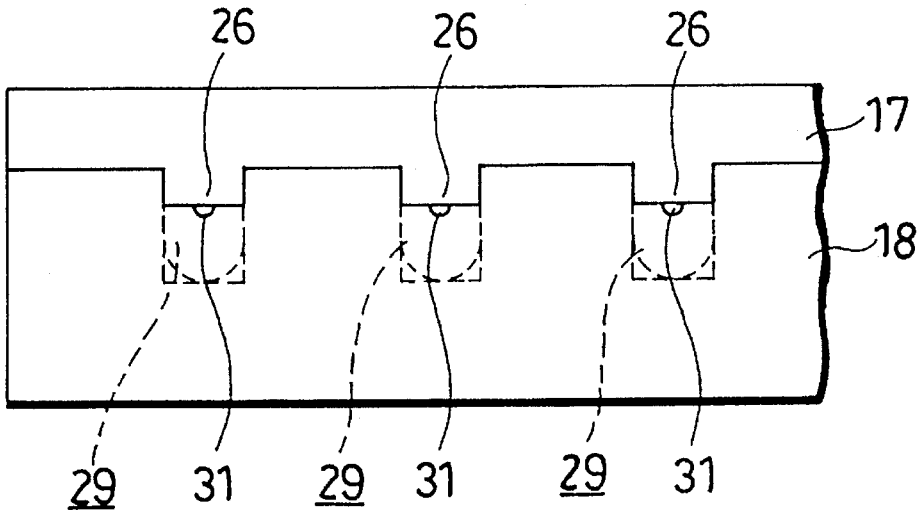
FIG. 12 is a front view of the multi-nozzle head of another embodiment.
Figure 13:
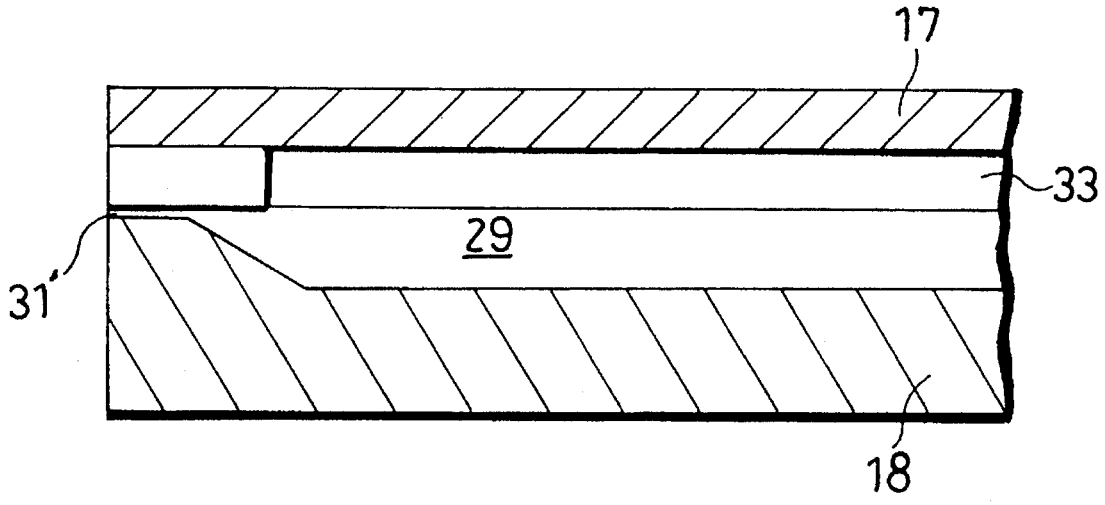
FIG. 13 is a sectional view of the multi-nozzle head of the same, taken in the direction of its depth.
Figure 14:
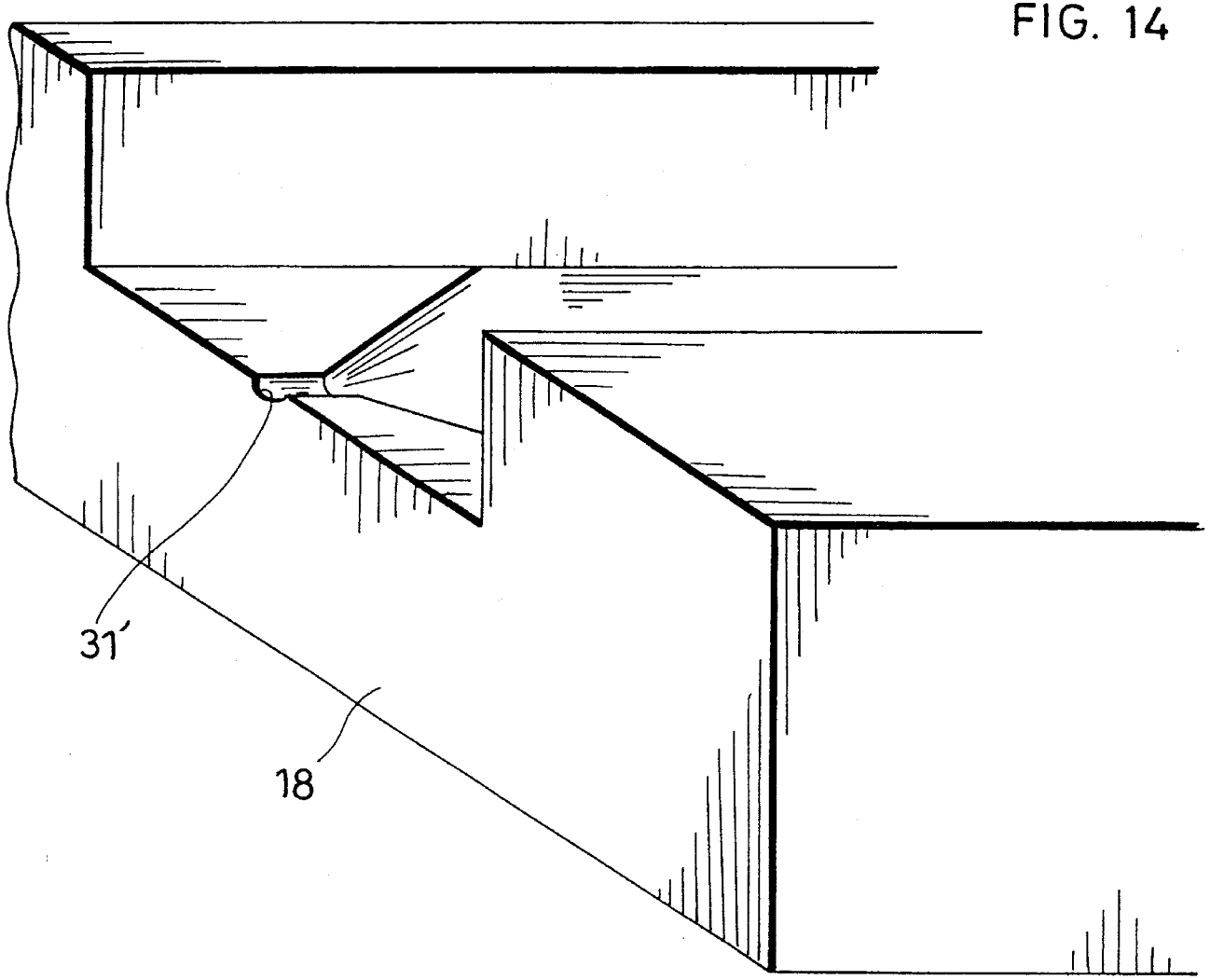
FIG. 14 is a perceptive view of the supporting member of the multi-nozzle head of the same.

As shown in FIGS. 12 through 14, the piezo-electric body 17 and the supporting member 18 may be constructed to be tightly engaged with each other with no gap in the region of the front surface of the multi-nozzle head 13, and small grooves 31' as nozzle holes 31 may be formed in the supporting member 18. Or, such small grooves as nozzle holes may be formed in the piezo-electric body 17.

Figure 15:
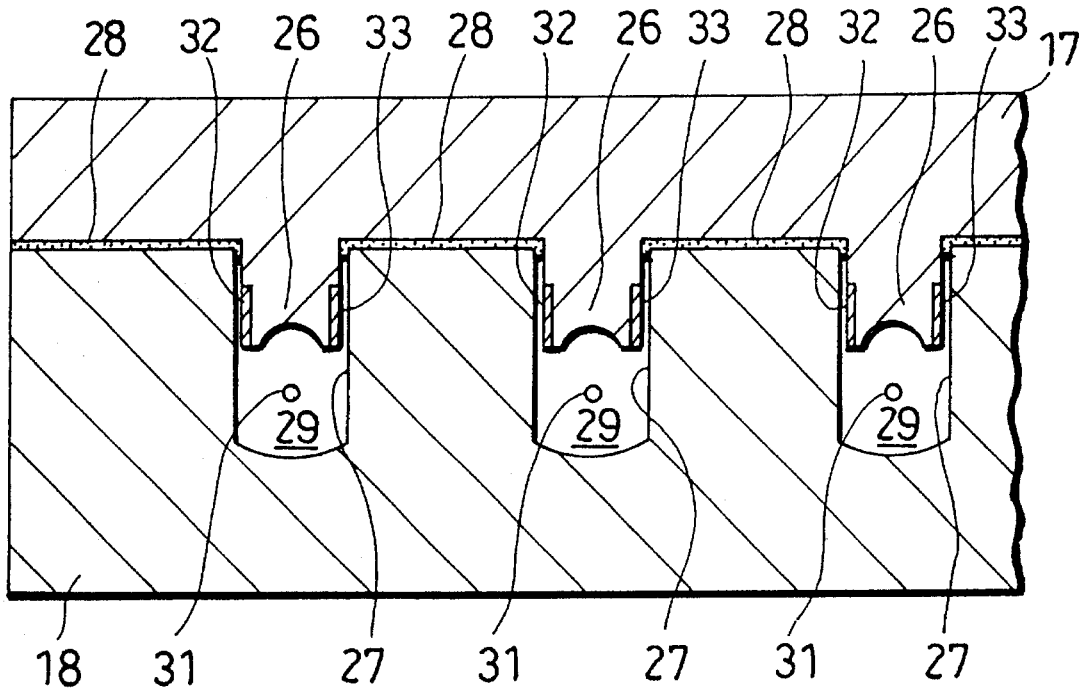
FIG. 15 is a sectional view of the multi-nozzle head of another embodiment of this invention.

As shown in FIG. 15, both the top surface of the protruding portions 26 and the inner surface of the bottom of the grooves 27 may be formed concave.

Figure 16:
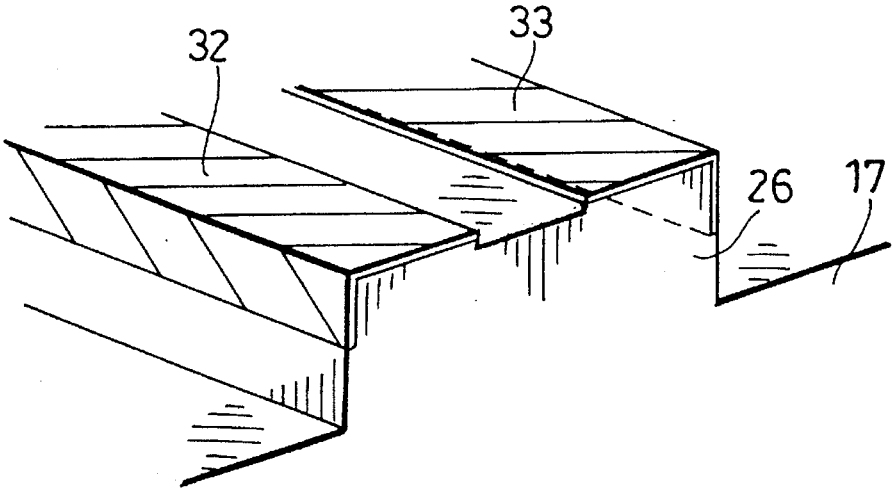
FIG. 16 is a perspective view of the protruding portion of the piezo-electric body of further another embodiment.

As shown in FIG. 16, the electrodes 32 and 33 may be formed in L-shape extending from a side surface to the top surface of the protruding portions 26. Such electrodes can be easily constructed by first evaporating metals from the top surface to both side surfaces of the protruding portions 26 and then dividing the electrodes 32 and 33 by forming a groove on the top surface of the protruding portions 26 with a dicing saw.

The elongated ink rooms 29 have one of two different length, the length of any adjacent ink rooms 29 being different, provided that the electrodes 32 and 33 are all of the same length. This construction realizes to prevent cross talks more efficiently, which mainly occur when the density of the nozzle holes 31 is increased or the viscosity of the ink is decreased in accordance with temperature rising. The cross talks are a phenomenon that ink in an ink room 29 is jetted by voltage applied for another ink room 29.

The electrodes 32 and 33 may be designed to become wider as they approach the nozzle holes 31. This design realizes to sufficiently prevent cross talks and improve responsibility of ink jetting.

Furthermore, the glue 28 to engage the piezo-electric body 17 and the supporting member 18 with each other may be only partially applied such as on both ends of each multi-nozzle head 13 in the direction of its width. Such an application of the glue 28 would not greatly decrease the pressure on the ink rooms 29 if the distance between the piezo-electric body 17 and the supporting member 18 is narrow enough.

In the above-mentioned embodiments, the supporting member 18 is provided with the ink supply slit 35 and ink is supplied to the ink rooms 29 through holes 24 of the ink lid 20. However, there are various well known ink supply methods, and any one of them may be selected, for example a method where ink is supplied through an ink supply tube from a side of the covering plate 21.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An ink jet recording apparatus comprising:

a piezo-electric body having a plurality of spaced protruding portions, each of the plurality of protruding portions having first and second side surfaces, wherein each of the protruding portions has first and second cuttings respectively formed on the first and second side surfaces thereof;

first and second electrodes buried in the first and second cuttings of the first and second side surfaces of each of the protruding portions, respectively;

a supporting member having a plurality of spaced hollow portions, each of the plurality of hollow portions being engaged with a respective one of said plurality of protruding portions to define a space between a top surface of each of the protruding portions and a bottom surface of each of the hollow portions, said space comprising an ink room;

a plurality of openings, each of the plurality of openings leading to a corresponding one of a plurality of ink rooms;

ink supplying means for supplying ink to the ink rooms; and voltage applying means for applying voltage between each of the first and second electrodes to generate an electric field for vibrating each of the protruding portions, thereby jetting ink in each of the ink rooms in the form of a droplet through each of the openings.

2. An ink jet recording apparatus of claim 1, wherein said piezo-electric body is polarized in a same direction as electric lines of force in the electric field, and each of the openings are positioned for ink to jet therefrom in a direction crossing a direction in which said piezo-electric body is vibrated.

3. An ink jet recording apparatus of claim 1, wherein each of said first and second electrodes is formed in a range from the top surface of each of the protruding portions to more than 20% of the height of each of the protruding portions.

4. An ink jet recording apparatus of claim 1, and further including ink heating means provided on the bottom surface of each of the hollow portions of said supporting member.

5. An ink jet recording apparatus of claim 1, wherein the bottom surface of each of the hollow portions comprises a curved surface.

6. An ink jet recording apparatus of claim 1, wherein the top surface of each of the protruding portions comprises a curved surface.

7. An ink jet recording apparatus of claim 1, wherein each of said first and second electrodes extends as far as part of the top surface from its respective side surface of its respective protruding portion.

8. An ink jet recording apparatus of claim 1, wherein adjacent ones of said plurality of protruding portions are of different length in a direction of ink jetting.

9. An ink jet recording apparatus of claim 8, wherein alternate ones of said plurality of protruding portions are of a same length in the direction of ink jetting.

10. An ink jet recording apparatus of claim 8, wherein all of said first and second electrodes are of a same length in the direction of ink jetting.

11. An ink jet recording apparatus comprising:

a piezo-electric body having a plurality of spaced protruding portions, each of the plurality of protruding portions having first and second side surfaces;

first and second electrodes provided on the first and second side surfaces of each of the protruding portions, respectively;

a supporting member having a plurality of spaced hollow portions, each of the plurality of hollow portions being engaged with a respective one of said plurality of protruding portions to define a space between a top surface of each of the protruding portions and a bottom surface of each of the hollow portions, said space comprising an ink room;

a plurality of openings, each of the plurality of openings leading to a corresponding one of a plurality of ink rooms;

ink supplying means for supplying ink to the ink rooms; and voltage applying means for applying voltage between each of the first and second electrodes to generate an electric field for vibrating each of the protruding portions, thereby jetting ink in each of the ink rooms in the form of a droplet through each of the openings, wherein each of said first and second electrodes becomes wider in a direction of ink jetting.

12. An ink jet recording apparatus comprising:

a piezo-electric plate having a plurality of protruding portions, said plurality of protruding portions being defined by forming a plurality of spaced grooves on a surface of said piezo-electric plate, each of the plurality of protruding portions having first and second side surfaces, a distance between said first and second side surfaces of each of the protruding portions being from 30 μm to 130 μm;

first and second electrodes provided on the first and second side surfaces of each of the protruding portions, respectively;

a supporting member having a plurality of spaced hollow portions, each of the plurality of hollow portions being engaged with a respective one of said plurality of protruding portions to define a space between a top surface of each of the protruding portions and a bottom surface of each of the hollow portions, said space comprising an ink room;

a plurality of openings, each of the plurality of openings leading to a corresponding one of a plurality of ink rooms;

ink supplying means for supplying ink to the ink rooms; and voltage applying means for applying voltage between each of the first and second electrodes to generate an electric field for vibrating each of the protruding portions, thereby jetting ink in each of the ink rooms in the form of a droplet through each of the openings, the voltage applied by said voltage applying means between each of the first and second electrodes being from 10 V to 200 V.

13. An ink jet recording apparatus of claim 12, wherein said voltage applying means applies a synthesized voltage consisting of an alternating voltage and a direct voltage.

14. An ink jet recording apparatus of claim 13, wherein a frequency of the alternating voltage is from 1 kHz to 10 MHz.

15. An ink jet recording apparatus comprising:

a piezo-electric body which has a protruding portion, said protruding portion having first and second side surfaces;

a supporting member which has a hollow portion corresponding to said protruding portion, wherein a depth of said hollow portion is larger than a height of said protruding portion, said supporting member being engaged with said piezo-electric body in a manner that said protruding portion is inserted into said hollow portion, wherein a space between a top surface of said protruding portion and a bottom surface of said hollow portion is formed as an ink room;

an opening which leads to said ink room;

first and second electrodes which are provided on the first and second surfaces of said protruding portion;

an ink supplier which supplies ink to said ink room; and a driver which applies voltage between said first electrode and said second electrode to operate said protruding portion, thereby jetting ink in said ink room in a form of a droplet through said opening.

* * * * *